United States Patent [19]

Lamort

[11] Patent Number: 4,607,802

[45] Date of Patent: Aug. 26, 1986

[54] TURBINES FOR FIBER SEPARATION

[75] Inventor: Jean-Pierre J. Lamort, Saint Lumier en Champagne, France

[73] Assignee: E et M Lamort, France

[21] Appl. No.: 599,091

[22] Filed: Apr. 11, 1984

[30] Foreign Application Priority Data

Apr. 22, 1983 [FR] France ..... 83 06636

[51] Int. Cl.[4] ..... B02C 23/36

[52] U.S. Cl. ..... 241/46 B; 241/46.17; 241/260.1

[58] Field of Search ..... 241/260.1, 46 B, 46.02, 241/46.17; 366/323

[56] References Cited

U.S. PATENT DOCUMENTS 2,626,132 1/1953 Reed ..... 366/323 X 3,323,570 6/1967 Tullock et al. ..... 366/323 X

*Primary Examiner*—Mark Rosenbaum

*Assistant Examiner*—Timothy V. Eley

*Attorney, Agent, or Firm*—Darby & Darby

[57] ABSTRACT

The invention relates to a primary pulper turbine for processing recycled paper, of the type having the general shape of an helix.

This turbine is formed of a shaft (2) carrying at least two helical disks (3, 4) coaxial to the shaft (2) and having a small pitch. These disks extend over at most 360° and are spaced from each other along the shaft (2) by a distance of at least 1.5 times the helical pitch of a disk. The turbine carries on its base a set of radially extending fins (6, 7, 8), each one of which is curved into a spiral starting from the shaft (2).

Preferably, the slant of the helical disks (3, 4, 5) relative to a plane perpendicular to the shaft (2) is approximately 15°, and the disks are angularly spaced from each other by a same angle approximately equal to 360° divided by the number of disks, for providing a proper dynamic balance of the turbine.

The turbine of the invention is designed so as to have a high separation power for fibers, and to separate contaminants, such as plastics, from the paper pulp, without breaking them up into small pieces. This design lends itself to the building of small efficient primary pulpers, the volume of which may be less than 5 $m^3$, as well as of larger ones.

10 Claims, 5 Drawing Figures

TURBINES FOR FIBER SEPARATION

This invention relates to turbines used for fiber separation, more particularly to such turbines forming part of a primary pulper unit designed for processing recovered waste paper as a preliminary stage in the production of paper pulp based on fibers obtained from such waste paper. More specifically, this invention relates to turbines of the kind considered, having the general shape of an helix.

The recovery of used paper takes an ever increasing place in the manufacturing of paper pulp. The first phase in the recovery of used paper consists in feeding batches of used paper into devices to which water is supplied, and submitting this paper to a first processing operation for disintegrating the fiber and for carrying out or facilitating the separation of the larger contaminants, such as pieces of rope, wire, large pieces of plastic materials, etc.

The recovery of used paper has recently become more difficult as a result of the increasing use of plastic materials, particularly of plastic sheets combined with the paper, and it is very important to achieve the separation of fibers without comminuting the plastic parts, which would make their separation more difficult.

Also, the need is being felt for primary pulpers of the kind considered which may be built in many different sizes, ranging from less than 5 cubic meters to more than 50 cubic meters and can operate satisfactorily irrespective of their size. A further important consideration is that the design of the pulper turbine should make it possible to obtain a mixture containing a high percentage of dry substance, for instance 20% by weight or possibly more.

BACKGROUND OF THE INVENTION

Two kinds of known devices are currently being used in the processing of used paper for fiber separation and for the elimination of contaminants such as, more particularly, plastic materials.

The first kind refers to disintegrator trommels and the second one to devices known as primary pulpers.

Trommels are usually designed as rotating cylinders having an horizontal axis, which are provided with shredder bars or balls, while sieve trommels or separator devices are provided downstream of such shredder trommels. However, these devices operate slowly, with only a small throughput, and they deliver a mixture having a low pulp concentration (from 2 to 3% dry substance), so that costly concentrating operations are subsequently required.

Primary pulpers are devices having the shape of generally open cylinders, in the bottom of which is provided a rotor carrying blades. In some of these devices, the rotor is relatively flat and exerts on the material being processed a violent centrifugal action in contact with a grid or perforated plate forming the bottom, causing the material to be shredded, a part of this material passing through the bottom for being subsequently processed in separators or in secondary pulpers.

One drawback of these devices is that they deliver a product having only a small concentration of dry substance, and that there is excessive shredding, not only of the fibrous portions which are to be recovered, but also of the non-fibrous portions (e.g. pieces of rope, metal parts, plastics).

It is however very important that the fibers should not be excessively shredded, and that the plastic contaminants should not be shredded at all, as much as possible. The above-mentioned devices have heretofore failed to achieve this purpose.

Some other kinds of pulpers, known as "Helico" pulpers, comprise a vertical-axis turbine having the shape of an helix, which imparts to the material an axial downward motion followed by a centrifugal motion along a smooth bottom. In these devices, fiber separation is achieved by the friction of fibers against fibers, while the centrifuged material is ejected against relatively immobile material. There is only a small amount of shredding, so that the contaminants are left intact and do not become divided, while the paper fibers are separated.

These devices usually operate in a discontinuous way, without a bottom grid, and the contents of the pulper is subsequently poured into separators which separate the good pulp from the contaminants. Such a separator is described in French Pat. No. 83.04 929 filed on Mar. 25, 1983 in the name of this Applicant.

The concentration obtained with these devices is in the vicinity of 15% dry substance, which is high enough for allowing a dilution in the classifiers located downstream.

However, a drawback of these pulper devices lies in the difficulty to build such devices having small dimensions. The need to achieve a balancing of the helix requires that 3 blades should be provided at 120° spacings, thus forming 3 channels between the blades. These channels wind around the vertical shaft, forming an helix with a short pitch in the upper part and then spread apart to form divergent centrifuging channels in the lower section.

When dealing with a 40 $m^3$ pulper, this device has a 2 m diameter with a height of 2.10 m, and there are 4 interwoven helix blades forming channels having a width from 50 to 70 centimeters. However, with smaller devices, having a volume of less than about 5 $m^3$ for instance, this helix turbine will not give good results. The reason is that the spaces between the helix blades are too narrow and that the material becomes jammed between the blades. For maintaining a sufficient spacing between the blades, their pitch should then be increased, but this will impart to the material a centrifugal speed component in the upper part of the helix, and this would work against a proper operation of the pulper. On another hand, in the larger pulpers, linear velocity along the axis is relatively slow when compared with the linear velocity at the periphery of the lower part of the helix, so that there is obtained at the lower part a tangential centrifugal exit velocity of the material which is sufficient for fiber separation.

The smaller models must however, owing to their small dimensions, rotate more slowly so as not to cause excessive centrifugation which would be detrimental to their fiber separation power.

This invention has the objective of bringing a remedy to these drawbacks and of providing for pulpers an helical turbine which will make it possible to build at a lesser cost and greater effectiveness a much wider range of pulpers, in respect of their volume, and more particularly to build efficient units having small dimensions.

SUMMARY OF THE INVENTION

The helix-shaped turbine according to this invention is characterized in that it is formed of a shaft which carries successively at least two helical disks coaxial with said shaft, having a small pitch, extending over at most 360° approximately, separated along the shaft by a distance at least equal to 1.5 times the helical pitch of the disks, the base of the turbine carrying a set of radially-extending fins having a spiral-shaped cross section perpendicular to the turbine shaft.

Preferably:

(a) The pitch of the upper helical disks is such that the peripheral slant of these disks relatively to a plane perpendicular to the axis should be in the range from 10° to 20°, preferably 15° approximately.

(b) The average diameters of the helical disks increase gradually from the top of the turbine towards its base.

(c) The bottom fins are curved so as to form a Bernouilli spiral having an angle comprised between 25° and 35° approximately (the tangent to the spiral at any point forming a constant angle comprised between 25° and 35°, preferably about 30°, with the tangent to the circle passing through this point).

(d) The various helical disks are offset relatively to each other by an angle of approximately 360° divided by the number of disks.

These features, together with further features and advantages of the invention, will appear in greater detail from the following description, with reference to the appended drawings in which.

DETAILED DESCRIPTION OF THE INVENTION

Figure 1:
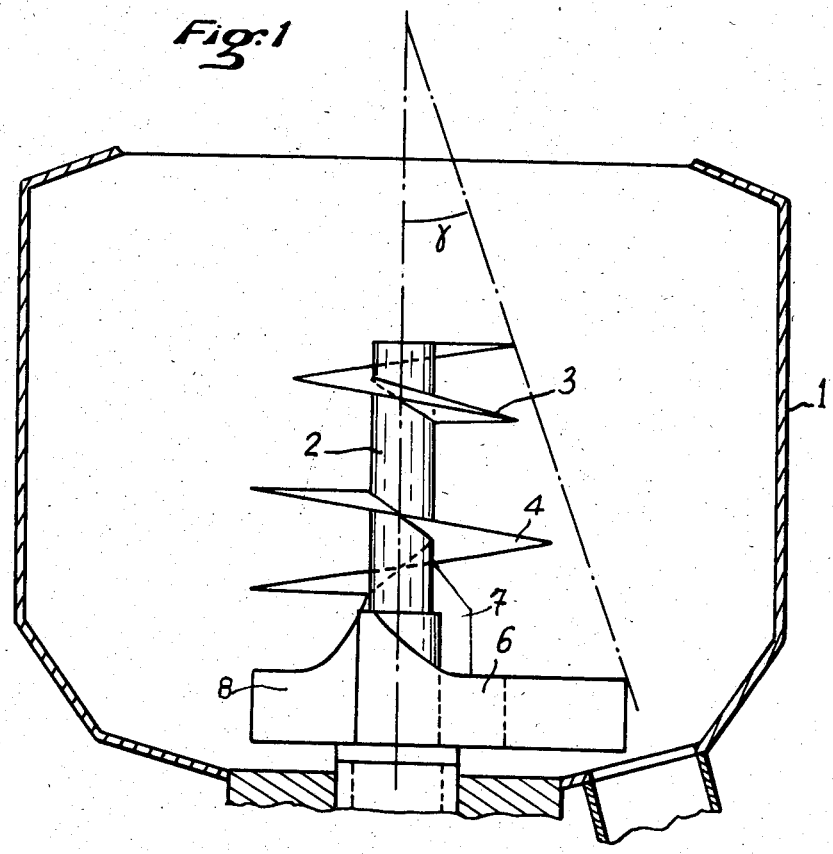
FIG. 1 is a diagrammatic vertical cross-section view of a primary pulper equipped with a turbine according to the invention.

Referring to the drawings, it can be seen that the turbine according to this invention, designed for being placed on the bottom of a primary pulper 1 having a known shape, is formed of a shaft 2 having an axis 9, this shaft carrying in succession, starting from its top, several helical disks 3, 4 and 5, spaced apart from each other, and at its base several spiral fins 6, 7 and 8.

The helical disks 3, 4 and 5 form helical windings having the shape of archimedean screws around the shaft 2, each disk extending over at most one complete turn (360°). The pitch of each disk is small, the slant $\alpha$ at the disk periphery being approximately 15°. The distance AB between the two adjacent disks, as measured alongside shaft 2, is on the contrary relatively large. This spacing determines the height of the channel defined by two adjacent disks, through which the material will flow down. This spacing may vary between relatively wide limits. According to the invention, the distance AB should be at least 1.5 times and preferably approximately twice the pitch of one disk.

Figure 4:
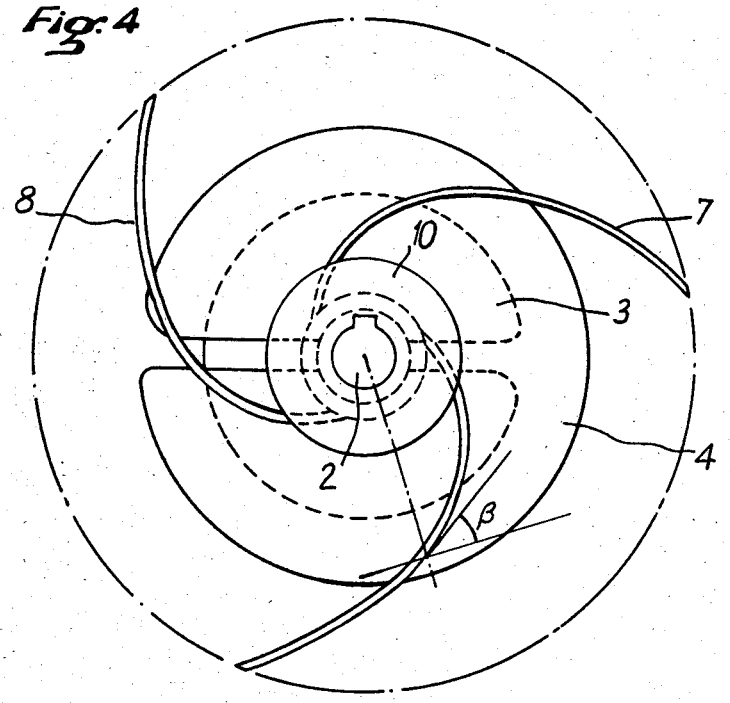
FIG. 4 is an axial view of the turbine of FIG. 2, seen from below.
Figure 5:
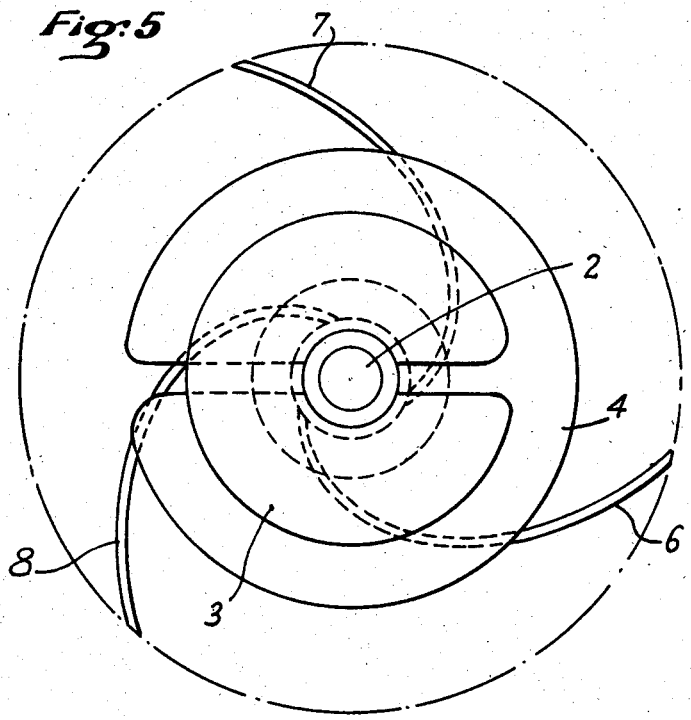
FIG. 5 is an axial view of the same turbine, seen from above.

The shape of the spiral fins 6, 7 and 8 is particularly visible on FIG. 4 (seen from below). Their general shape is that of fins which extend spirally from the shaft 2. Preferably, their curve is that of a Bernouilli spiral having a constant angle $\beta$ comprised between 25° and 35°. The height of fins 6, 7 and 8 is preferably decreasing from shaft 2 to their ends, while the highest point of each fin may be in the vicinity of the nearest helical disk. There should preferably be at least three such fins. They are inscribed within a circle having a greater diameter than the one defined by the disks 3, 4 and 5.

The assembly thus formed is inscribed within a general cone or bell shape having an apex angle $\gamma$ comprised between 60° and 80° approximately.

Being thus constituted, the turbine according to the invention presents itself in the form of a shaft carrying a succession of helical disks having increasing diameters, spaced apart from each other and followed by a centrifuge rotor having spiral fins.

The advantages of the invention are as follows :

The fact that there is no longer being used a turbine having continuous blades from top to bottom, but that there is provided instead a turbine formed of superposed separate disks, makes it possible to obtain a flow channel which is sufficiently large, while maintaining a small slant for the helical disks. As a result, the material being processed is really driven vertically through the upper part of the turbine, without jamming and without any detrimental centrifugal effect. On the contrary, the feed through the spiral fins becomes more effective, so that these fins have a more effective centrifuge action which is more properly localized at the very base of the turbine.

As a result, it becomes possible to build small units, with less than 5 $m^3$ volume, as well as large units ranging from 5 $m^3$ to 50 $m^3$.

Moreover, the turbine of the invention is capable of operating at higher concentrations which may exceed 20%, i.e. more than 200 grammes dry substance per liter, whereby the fiber separation power of the turbine is increased. This is due to the fact that there is less contact between the material being processed and the turbine, and that the centrifugation is more properly localized at the base of the turbine. This also brings about a reduction in energy consumption for the operation of the primary pulper as well as for the downstream separators.

Finally, the manufacturing cost of the turbine is considerably reduced thanks to the simplicity of the shapes of the turbine parts.

Compared to the manufacturing cost of "Helico" type turbines now available on the market, the manufacturing cost of the turbine according to the invention is from 4 to 5 times less, which is a considerable difference.

The turbine according to the invention is therefore opening up new prospects of development for this kind of primary pulpers.

Figure 2:
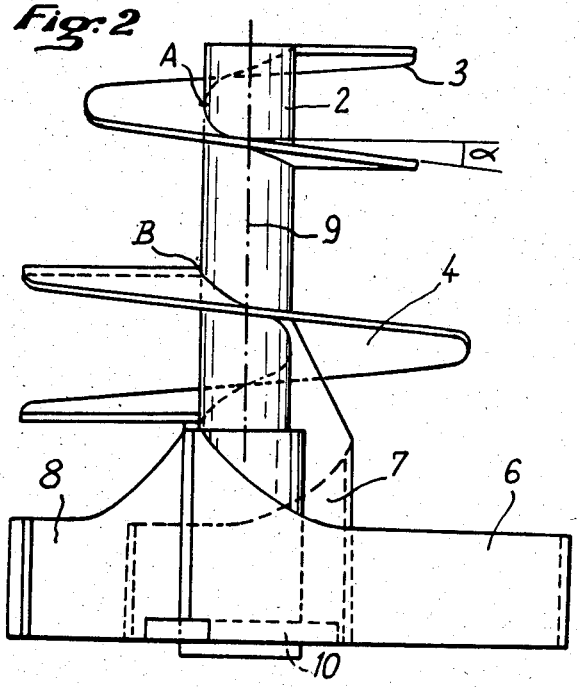
FIG. 2 is an elevation view of a turbine according to the invention having two disks and three spiral fins.
Figure 3:
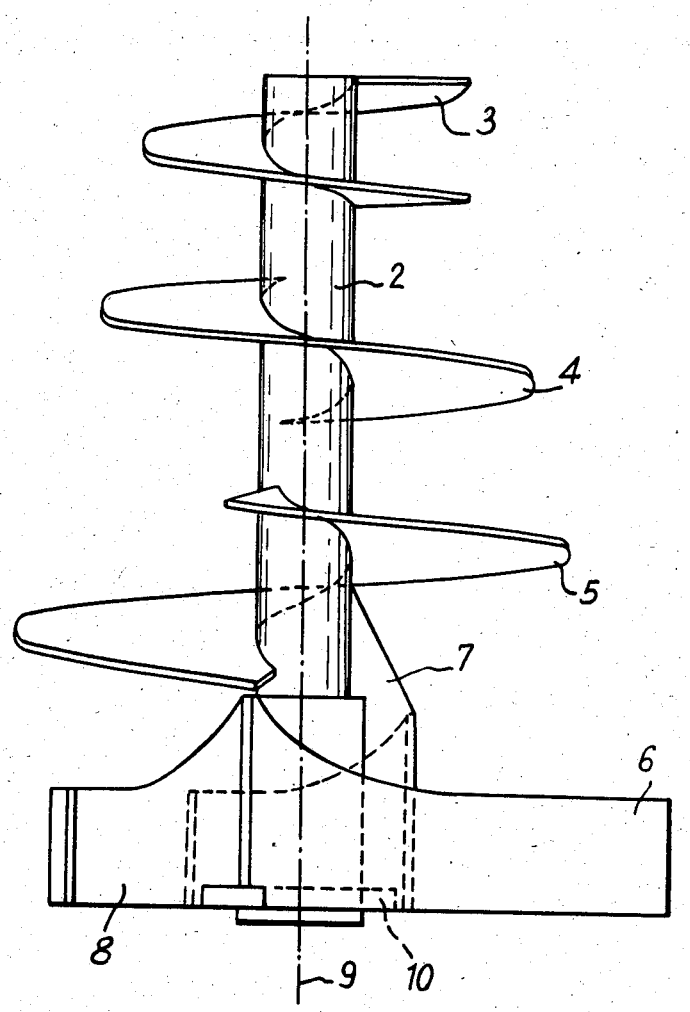
FIG. 3 is an elevation view of a turbine according to the invention, having three disks and three spiral fins.

In the example of FIG. 2, the turbine comprises two helical disks 3 and 4 which are offset by approximately 180°, whereas in the example of FIG. 3 there are provided three such disks 3, 4 and 5, offset by approximately 120°. These offset angles are those providing the best balance in rotation, taking into account the differences in the diameters of the various disks.

Preferably, each helical disk should not extend over more than one complete turn, i.e. 180°, for avoiding the formation of a narrow channel and the ensuing risk of jamming. The disks may also be more divided so that they will then extend over a much smaller angle. It is however preferred that their extension should be kept closer to one full turn, for avoiding a multiplicity of leading edges which may cause an excessive disintegration of the material and bring about a risk of jamming.

A washer 10 for supporting the spiral fins 6, 7 and 8 is preferably provided at the base of the turbine.

What is claimed is:

1. Pulping apparatus for the processing of recovered waste paper comprising:

a primary pulper open housing; and a pulper turbine mounted inside and in the bottom of said open housing, said turbine having the general shape of a helix, said turbine including a vertical shaft carrying successively at least two separate helical disks coaxial to the shaft, said disks having a small pitch and extending angularly around said shaft over at most 360° approximately, separated along the shaft by a distance at least equal to 1.5 times the helical pitch of one disk, the base of the turbine shaft carrying a set of radially-extending fins curved into a spiral shape starting from the shaft, a generating line of said fins being substantially parallel to the vertical shaft axis;

wherein the largest diameter of any one of said disks is substantially smaller than the inside diameter of said primary pulper housing, whereby said recovered waste paper being pulped is imparted first a downward motion in said housing, toward said fins, and then an outward motion from said turbine shaft, toward the inner wall of said housing upon rotation of said turbine in a predetermined direction.

2. Pulping apparatus according to claim 1, wherein the peripheral slant of each helical disk relatively to a plane perpendicular to the shaft is approximately 15°.

3. Pulping apparatus according to any of claims 1 or 2, wherein the spacing between two helical disks measured along the shaft is at least twice the pitch of one of said disks.

4. Pulping apparatus according to claim 1, wherein the average diameters of the helical disks increase from the top of the turbine shaft towards the shaft base.

5. Pulping apparatus according to claim 4, wherein the outer diameters of the helical disks are inscribed within a cone having an apex angle of between 60° and 80° approximately.

6. Pulping apparatus according to claim 1, wherein the helical disks are angularly offset around the shaft axis by an angle approximately equal to 360° divided by the number of disks.

7. Pulping apparatus according to claim 1, wherein the extension of the helical disks around the shaft is approximately 360°.

8. Pulping apparatus for the processing of recovered waste paper comprising:

a primary pulper housing; and a pulper turbine mounted inside said housing, said turbine having the general shape of a helix, said turbine including a shaft carrying successively at least two helical disks coaxial to the shaft said disks having a small pitch and extending over at most 360° approximately, separated along the shaft by a distance at least equal to 1.5 times the helical pitch of one disk, the base of the turbine shaft carrying a set of radially-extending fins curved into a spiral shape starting from the shaft;

wherein the largest diameter of any one of said disks is substantially smaller than the inside diameter of said primary pulper housing, wherein each of the lower fins is curved into a Bernoulli spiral having an angle of between 25° and 35°.

9. Pulping apparatus according to claim 1, wherein the lower fins are curved blades having decreasing heights from the shaft to their periphery.

10. Pulping apparatus according to claim 1, wherein the tips of the lower fins are inscribed within a circle having a larger diameter than any one of the helical disks.

* * * * *